US010506871B1

(12) United States Patent
Wilson

(10) Patent No.: US 10,506,871 B1
(45) Date of Patent: Dec. 17, 2019

(54) COLLAPSIBLE, SURFACE-MOUNTED APPARATUS

(71) Applicant: Justin R. Wilson, Denver, CO (US)

(72) Inventor: Justin R. Wilson, Denver, CO (US)

(73) Assignee: Justin R. Wilson, Denver, CO (US)

( * ) Notice: Subject to any disclaimer, the term of this patent is extended or adjusted under 35 U.S.C. 154(b) by 0 days.

(21) Appl. No.: 16/025,648

(22) Filed: Jul. 2, 2018

Related U.S. Application Data

(60) Provisional application No. 62/528,106, filed on Jul. 2, 2017.

(51) Int. Cl.
*A47B 5/04* (2006.01)

(52) U.S. Cl.
CPC ..... *A47B 5/04* (2013.01); *A47B 2200/0036* (2013.01)

(58) Field of Classification Search
CPC .. A47B 5/006; A47B 5/00; A47B 5/04; A47B 46/005; A47B 2200/0036; B60N 3/004
See application file for complete search history.

(56) References Cited

U.S. PATENT DOCUMENTS 2,716,044 A * 8/1955 Overby ..... A47B 5/04 108/134
3,157,379 A * 11/1964 Platakis ..... A47B 5/04 108/142
4,480,556 A * 11/1984 Wilson ..... D06F 81/06 108/48
5,240,215 A * 8/1993 Moore ..... A47B 5/04 108/10
5,595,128 A * 1/1997 De Ladurantaye ..... A47B 5/00 108/140
6,347,590 B1 * 2/2002 D'Annunzio ..... B60N 3/002 108/25
8,267,017 B1 * 9/2012 Michael ..... A47B 5/04 108/134
8,613,349 B1 * 12/2013 Halko ..... A45C 9/00 190/11
9,027,486 B1 * 5/2015 Berkovitz ..... B60N 3/002 108/40
9,357,839 B1 * 6/2016 Liu ..... A47B 5/02
2006/0107877 A1 * 5/2006 Sturt ..... A47B 5/00 108/44
2011/0067606 A1 * 3/2011 Sundarrao ..... A47B 3/00 108/44
2012/0304897 A1 * 12/2012 Williamson ..... A47B 3/00 108/50.11

(Continued)

*Primary Examiner* — Hanh V Tran
(74) *Attorney, Agent, or Firm* — Holzer Patel Drennan

(57) ABSTRACT

An apparatus configurable between a stowed or collapsed position against a support surface (e.g., wall) and a deployed position extending from the support surface for support of objects thereon. The apparatus is configured to make simultaneous use of first and second perpendicular pivot axes to both rotate the apparatus about the first pivot axis through the support surface and pivot first and second pieces of the apparatus relative to each other about the second pivot axis as the furniture system moves between the stowed and deployed positions. This ergonomic and balanced arrangement advantageously allows users to move the apparatus between the stowed and deployed positions with reduced levels of effort.

22 Claims, 13 Drawing Sheets

(56) References Cited

U.S. PATENT DOCUMENTS

| | | | | |
|---|---|---|---|---|
| 2013/0161463 | A1* | 6/2013 | Toms | A47C 1/126<br>248/240.4 |
| 2013/0181490 | A1* | 7/2013 | Lin | A47B 5/00<br>297/145 |
| 2014/0310873 | A1* | 10/2014 | Gosling | A47B 5/04<br>5/136 |
| 2014/0373759 | A1* | 12/2014 | Rumeau | B64D 11/04<br>108/44 |
| 2015/0284088 | A1* | 10/2015 | Gow | B64D 11/0638<br>297/174 R |
| 2015/0321592 | A1* | 11/2015 | De Morais | B64D 11/06<br>297/147 |
| 2016/0167555 | A1* | 6/2016 | Allen | B64D 11/0638<br>108/40 |
| 2018/0029513 | A1* | 2/2018 | Jergenson | A47B 83/045 |

* cited by examiner

COLLAPSIBLE, SURFACE-MOUNTED APPARATUS

CROSS REFERENCE TO RELATED APPLICATION

This application claims the benefit of U.S. Patent App. No. 62/528,106, entitled "MOON TABLE," and filed on Jul. 2, 2017, the entire contents of which is incorporated herein by reference.

BACKGROUND

1. Field of the Invention

The present invention generally relates to apparatuses such as furniture and, more particularly, to surface-mounted furniture that can be selectively deployed for use and collapsed for storage.

2. Relevant Background

In large, multi-purpose rooms that are utilized at various times (e.g., dining rooms, meeting halls, dance areas, training rooms, classrooms, etc.), it is often desirable to utilize furniture that is capable of being collapsed or folded away when not in use. For instance, numerous wall-mounted, folding tables exist that allow users to selectively deploy the tables for use and fold the same against the wall for storage when not in use. While such collapsible furniture exists, there continues to remain a need for collapsible furniture that is easy to operate; folds into small spaces and unfolds repeatedly and reliably; and which can be economically produced, installed, and maintained.

SUMMARY

Disclosed herein is an apparatus and method for use thereof that is configurable between a stowed or collapsed position against a support surface (e.g., wall) and a deployed position extending from the support surface. As will be discussed in more detail herein, the apparatus is configured to make simultaneous use of first and second perpendicular pivot axes to both rotate the apparatus about the first pivot axis through the support surface and pivot first and second pieces of the apparatus relative to each other about the second pivot axis as the apparatus moves between the stowed and deployed positions. This ergonomic and balanced arrangement advantageously allows users to move the apparatus between the stowed and deployed positions with reduced levels of effort.

In one aspect, an apparatus disclosed herein includes a mounting assembly securable to a support surface, a first section of an apparatus pivotally attached to the mounting assembly for rotation about a first pivot axis, a second section of the apparatus pivotally attached to the first section of the apparatus for rotation about a second pivot axis that is perpendicular to the first pivot axis, and a support mechanism pivotally interconnected between the mounting assembly and the second section of the apparatus, where rotation of the second section of the apparatus about the second pivot axis induces rotation of the first section of the apparatus about the first pivot axis.

In another aspect, a method of operating a wall-mounted piece of furniture includes rotating first and second sections of a furniture piece about a first pivot axis that extends through the first section of the furniture piece and into the wall, and pivoting, simultaneous with the rotating, the second section of the furniture piece relative to the first section of the furniture piece about a second pivot axis that is perpendicular to the first pivot axis from a stowed position against the wall into a deployed position extending from the wall.

In addition to the exemplary aspects and embodiments described above, further aspects and embodiments will become apparent by reference to the drawings and by study of the following descriptions.

DETAILED DESCRIPTION

Figure 1:
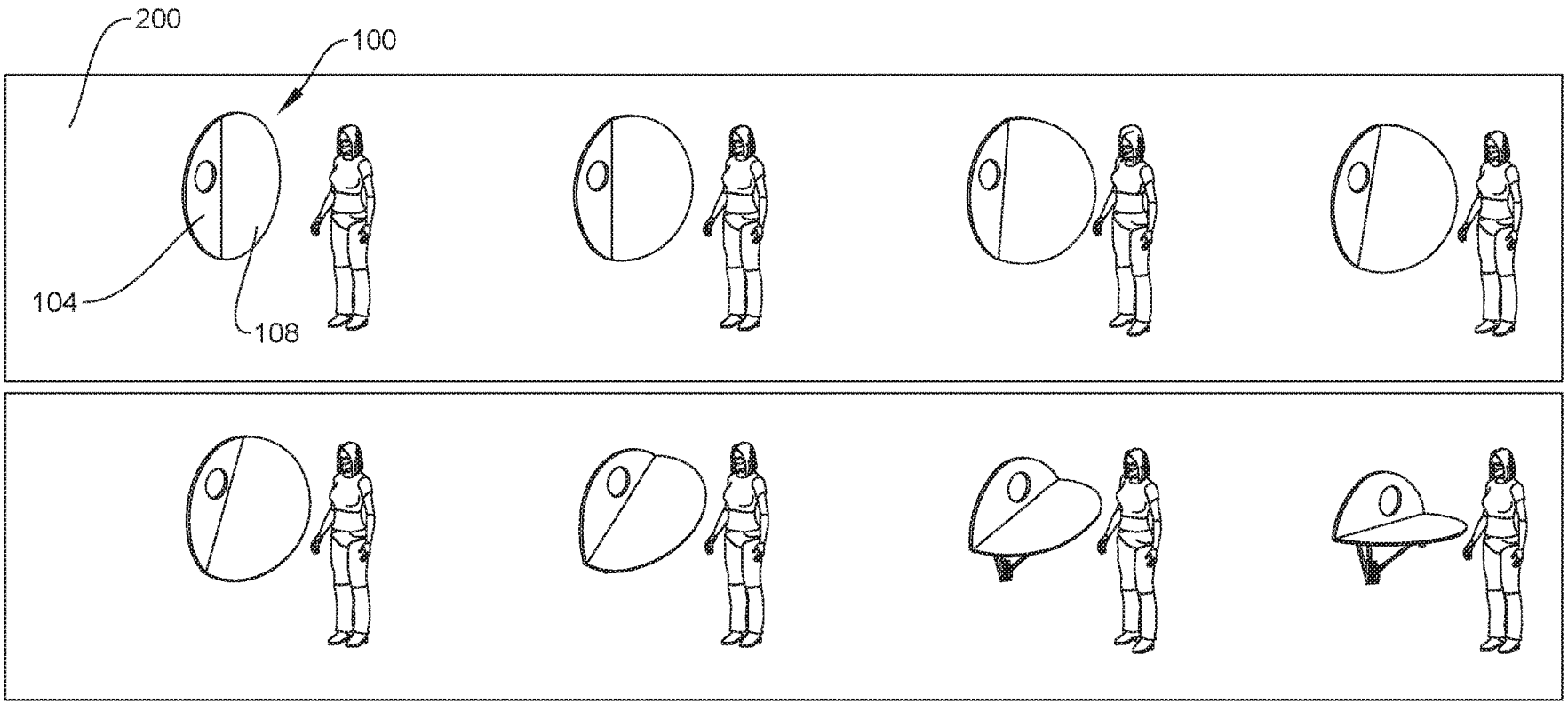
FIG. 1 presents a succession of images illustrating movement of an apparatus between a stowed position against a support surface and a deployed position extended from the support surface.

FIG. 1 presents a succession of images illustrating movement of an apparatus such as a furniture system 100 between a stowed position against a support surface 200 (e.g., wall) and a deployed position extended from the support surface 200. In the stowed position against the support surface 200, the furniture system may be disposed substantially flat against the support surface 200 to occupy a reduced volume of space. To deploy the furniture system 100, a user may grab one piece 108 of the system and pivot the piece 108 relative to an adjacent piece 104 while simultaneously rotating both pieces 104, 108 until the one piece 108 extends from the support surface 200 and the adjacent piece 104 (e.g., extends perpendicularly from the support surface 200 and the adjacent piece). It is noted that pivoting of the one piece 108 relative to the adjacent piece 104 may induce the simultaneous rotation of both pieces 104, 108. The user may reverse the above steps to stow the furniture system.

FIGS. 2A-2G, FIGS. 3A-3F, and FIGS. 4A-4G present respective successions of images illustrating movement of an apparatus such as a furniture system 300 (e.g., similar to the furniture system 100 of FIG. 1) between a stowed position against a support surface 400 (e.g., wall) to a deployed position extended from the support surface 400. Broadly, the furniture system 300 includes a mounting assembly 302 securable (e.g., rigidly or non-movably) to the support surface 400, a first section 304 of furniture (e.g., panel, leaf, etc.) pivotally attached to the mounting assembly 302 for rotation about a first pivot axis 500, a second section 308 of furniture (e.g., panel, leaf, etc.) pivotally attached to the first furniture section 304 for rotation about a second pivot axis 600 that is perpendicular to the first pivot axis 500 (e.g., where the first and second pivot axes 500, 600 may be non-intersecting in some embodiments), and a support mechanism 312 pivotally interconnected between the mounting assembly 302 and the second furniture section 308. While the first and second furniture pieces 304, 308 are illustrated as respectively serving as a backsplash and main panel of a collapsible table, it is to be understood that the teachings presented herein can be incorporated into other types of furniture that are desired to be selectively movable between stowed and deployed positions relative to a support surface (e.g., wall, floor, etc.).

The mounting assembly 302 may broadly be in the form of one or more brackets or the like of any appropriate materials and dimensions rigidly and non-movably mountable to the support surface 400 in any appropriate manner for supporting the weight of the first and second furniture pieces 304, 308 (e.g., as well as objects placed thereon, etc.) on the support surface 400. As just one example, a number of fasteners (not shown) may be extended through apertures in the mounting assembly 302 and into anchoring members (e.g., studs) in the support surface 400 in any appropriate manner. As shown, the mounting assembly 302 may generally include a front surface 318 facing away from the support surface 400 and an opposite rear surface 320 facing towards the support surface 400.

The first and second furniture pieces 304, 308 may be pivotally interconnected along the second pivot axis 600 by a hinge assembly 322 in any appropriate manner. For instance, the hinge assembly 322 may include a first hinge member 324 (e.g., bracket, etc.) rigidly or non-movably attached to the first furniture piece 304 (e.g., via fasteners, rivets, etc.) along an edge thereof and a second hinge member 326 (e.g., bracket, etc.) rigidly or non-movably attached to the second furniture piece 308 (e.g., via fasteners, rivets, etc.) along an edge thereof. The first and second hinge members 324, 326 may be pivotally connected along the second pivot axis 600 in any appropriate manner to thereby pivotally connect the first and second furniture pieces 304, 308.

A pivot assembly 328 may pivotally interconnect the first furniture piece 304 to the mounting assembly 302 about the first pivot axis 500. For instance, the pivot assembly 328 may be directly connected between the first hinge member 324 and the mounting assembly 302. The pivot assembly 328 may include any appropriate combination of pins, washers, etc. to allow for pivoting of the first furniture piece 304 about the first pivot axis 500. As the second furniture piece 308 is pivotally attached to the first furniture piece 304 about the second pivot axis 600, the second furniture piece 308 is also rotatable about the first pivot axis 500 simultaneous with rotation of the first furniture piece 304 about the first pivot axis 500.

As discussed previously, the support mechanism 312 is pivotally interconnected between the mounting assembly 302 (and the support surface 400) and the second furniture piece 308 and is broadly configured to urge the second furniture piece 308 away from the support surface 400 about the second pivot axis 600 (and support the second furniture piece 308) as the first and second furniture pieces 304, 308 are being pivoted about the first pivot axis 500. As an example, the support mechanism 312 may be in the form of an elongated rod or post having a first end 330 that is pivotally connected to the mounting assembly 302 by a first pivot assembly 332, an opposite second end 334 that is pivotally connected to the second furniture piece 308 by a second pivot assembly 336, and a longitudinal axis 337 extending between the first and second ends 330, 334. More specifically, the first pivot assembly 332 may allow for pivoting of the support mechanism 312 relative to the mounting assembly 302 and support surface 400 about third and fourth perpendicular pivot axes 700, 800. Stated differently, the support mechanism 312 may essentially swing about the third pivot axis 700 and tilt relative to the mounting assembly 302 and the support surface 400 about the fourth pivot axis 800. Furthermore, the third pivot axis 700 may be fixed on and relative to the mounting assembly 302 and support surface 400 while the fourth pivot axis 800 may swing and pivot with the support mechanism 312 about the third pivot axis 700. The longitudinal axis 337 of the support mechanism 312 may also be perpendicular to the fourth pivot axis 800.

Figure 5:
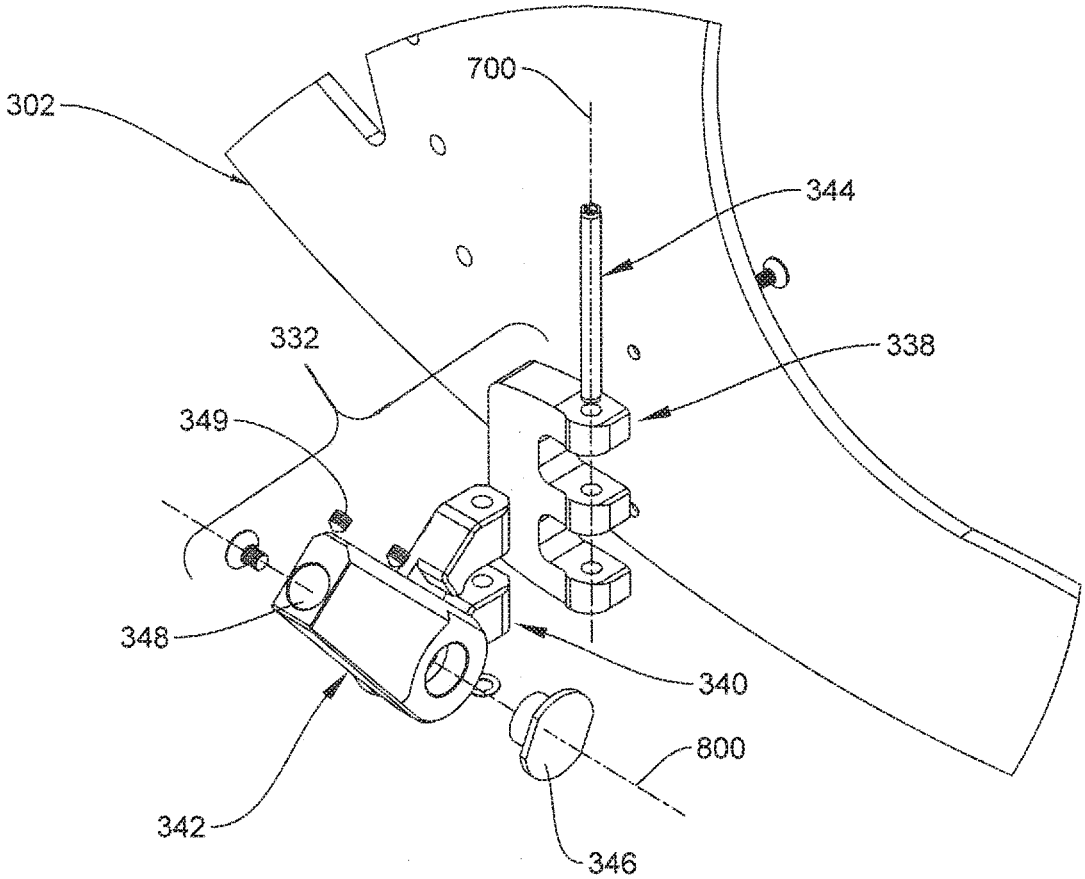
FIG. 5 is a close-up, partially exploded perspective view illustrating a pivot system between a mounting assembly and a support mechanism of the apparatus of FIGS. 2A-2G.

FIG. 5 illustrates a close-up, partially exploded perspective view of one embodiment of the first pivot assembly 332. In this embodiment, the first pivot assembly 332 may include a first pivot member 338 that is rigidly attachable to the mounting assembly 302 (e.g., via one or more fasteners, not shown) and a second pivot member 340 that is pivotally attachable to the first pivot member 338 for rotation about the third pivot axis 700. For instance, a pivot pin 344 may be inserted through aligned apertures in the first and second pivot members 338, 340 along the third pivot axis 700. Also in this embodiment, a third pivot member 342 may be pivotally attachable to the second pivot member 340 for rotation about the fourth pivot axis 800, such as via inserting a pivot pin 346 through aligned apertures in the second and third pivot members 340, 342 along the fourth pivot axis 800. In this arrangement, the second pivot member 340 may serve as an intermediate member to the first and third pivot members 338, 342. The third pivot member 342 may include an aperture 348 for receipt of the first end 330 of the support mechanism 312. For instance, one or more set screws 349 or the like may be threadably inserted through apertures in the third pivot member into contact with the first end 330 of the support mechanism 312 to secure the first end 330 against rotation about the longitudinal axis 337 within the aperture 348.

The second pivot assembly 336 may allow for pivoting of the support mechanism 312 relative to the second furniture piece 308 about fifth and sixth perpendicular pivot axes 900, 1000. Stated differently, the support mechanism 312 may essentially swing about the fifth pivot axis 900 and tilt relative to the second furniture piece 308 about the sixth pivot axis 1000. Furthermore, the fifth pivot axis 900 may be fixed on and relative to the second furniture piece 308 (e.g., via mounting bracket 350) while the sixth pivot axis 1000 may swing and pivot with the support mechanism 312 about the fifth pivot axis 900. The longitudinal axis 337 of the support mechanism 312 may also be perpendicular to the sixth pivot axis 1000, where the second pivot assembly 336 may be configured to rotate relative to the support mechanism 312 about the longitudinal axis 337. While not discussed in more detail in the interest of brevity, the second pivot assembly 336 may be similar to the embodiment of the first pivot assembly illustrated in FIG. 5.

Figure 2A:
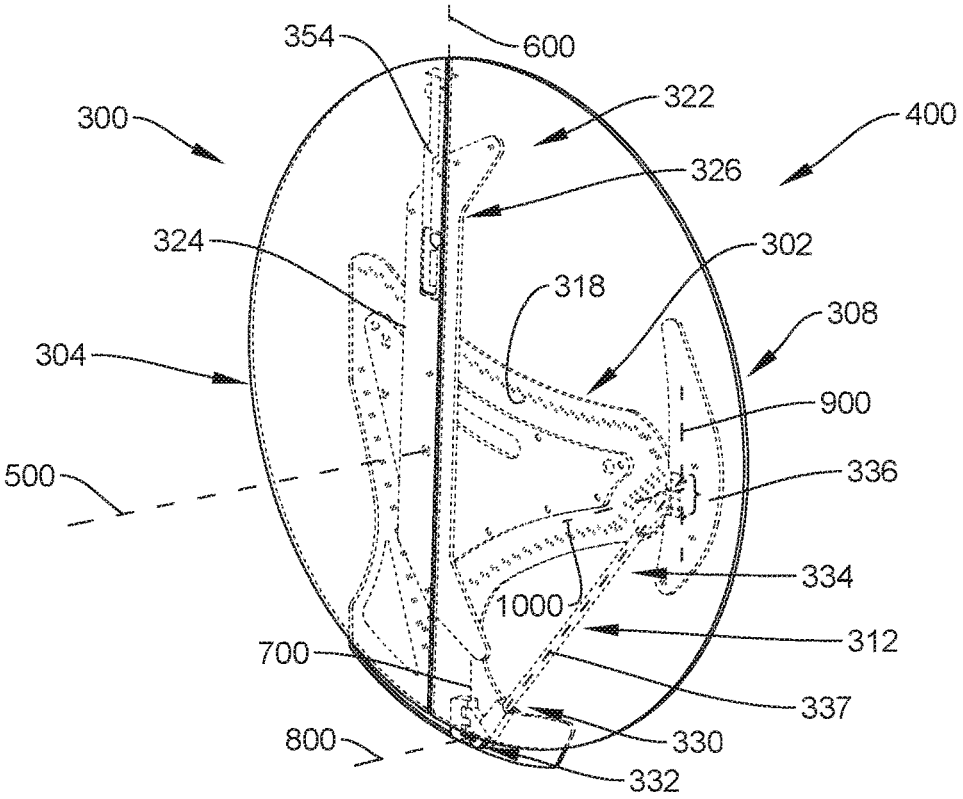
FIGS. 2A-2G present a succession of images illustrating movement of an apparatus between a stowed position against a support surface and a deployed position extended from the support surface, from a front perspective view of an apparatus.
Figure 2B:
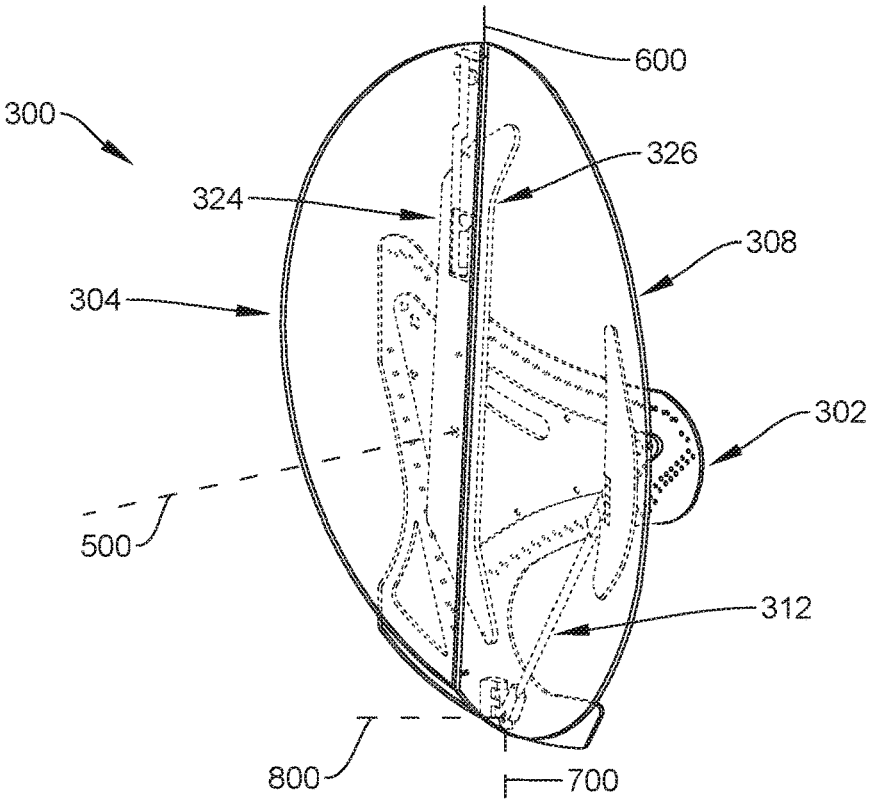
Figure 2C:
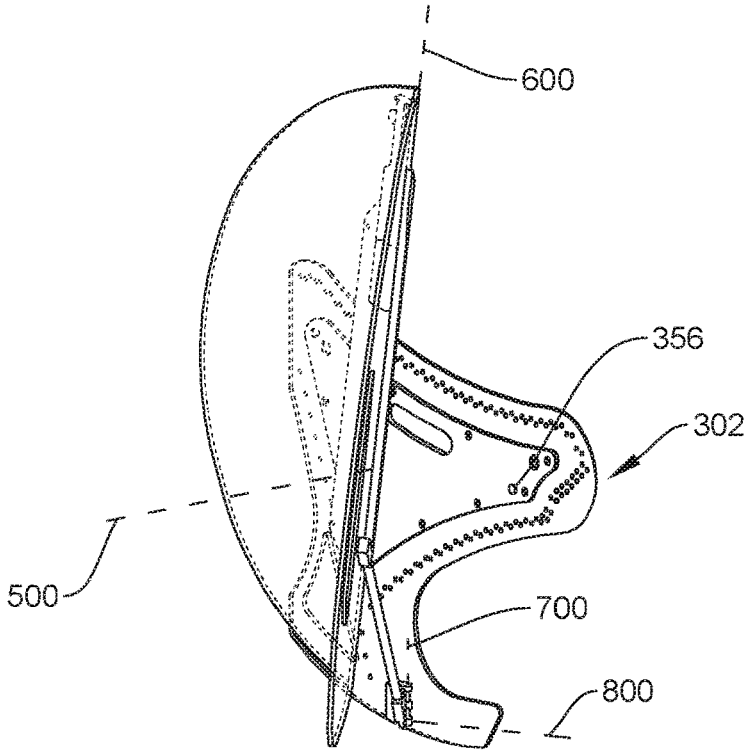
Figure 2D:
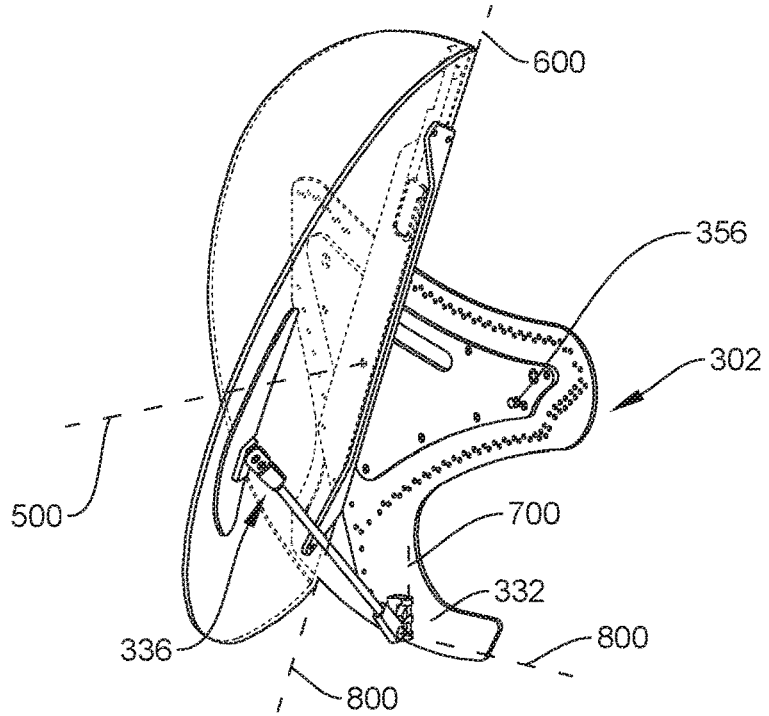
Figure 2E:
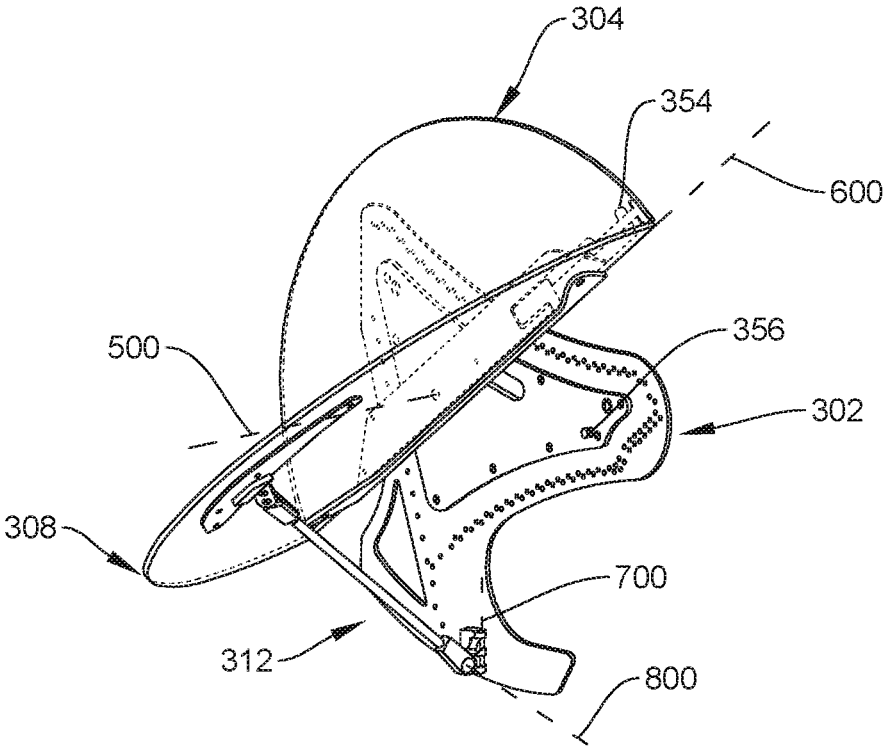
Figure 2F:
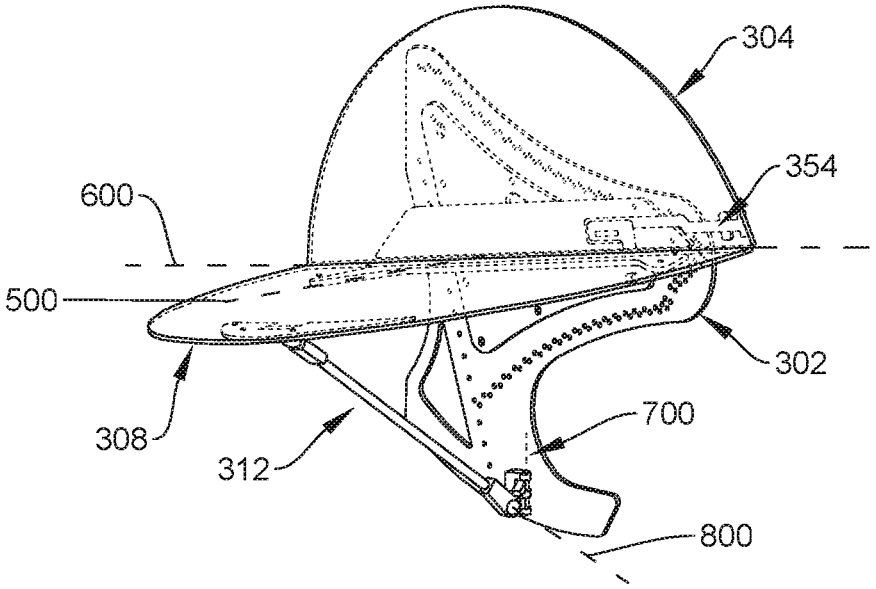
Figure 3A:
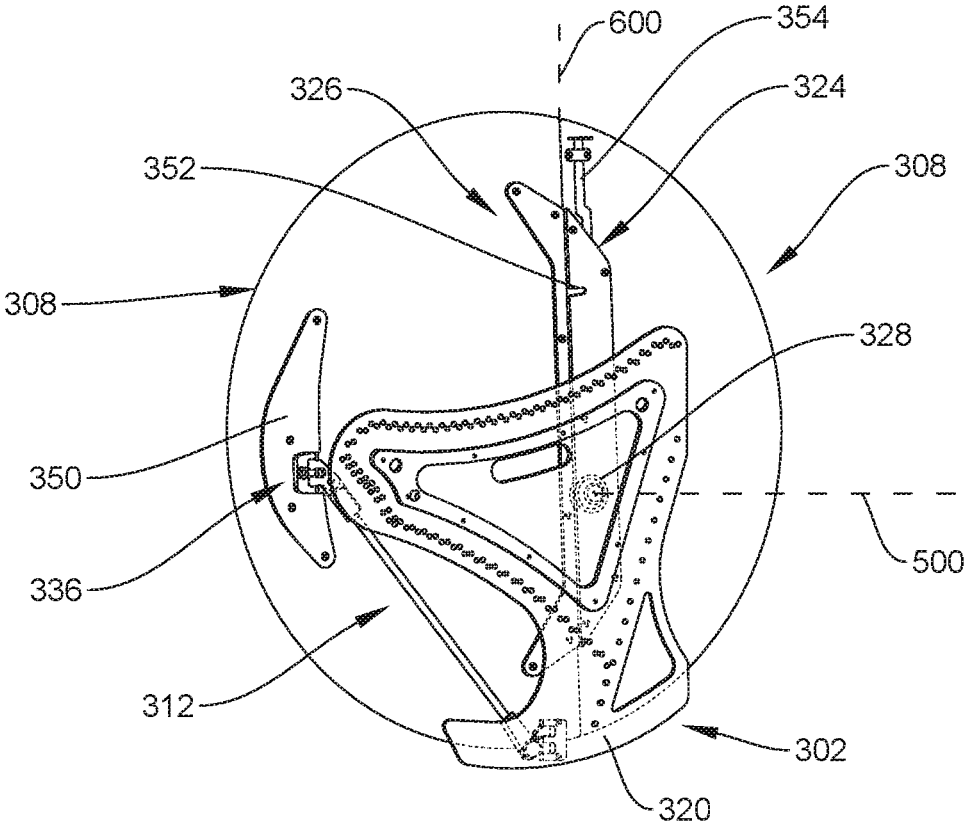
FIGS. 3A-3F present a succession of images illustrating movement of the apparatus of FIGS. 2A-2G between a stowed position against a support surface and a deployed position extended from the support surface, from a rear perspective view of the apparatus.
Figure 3B:
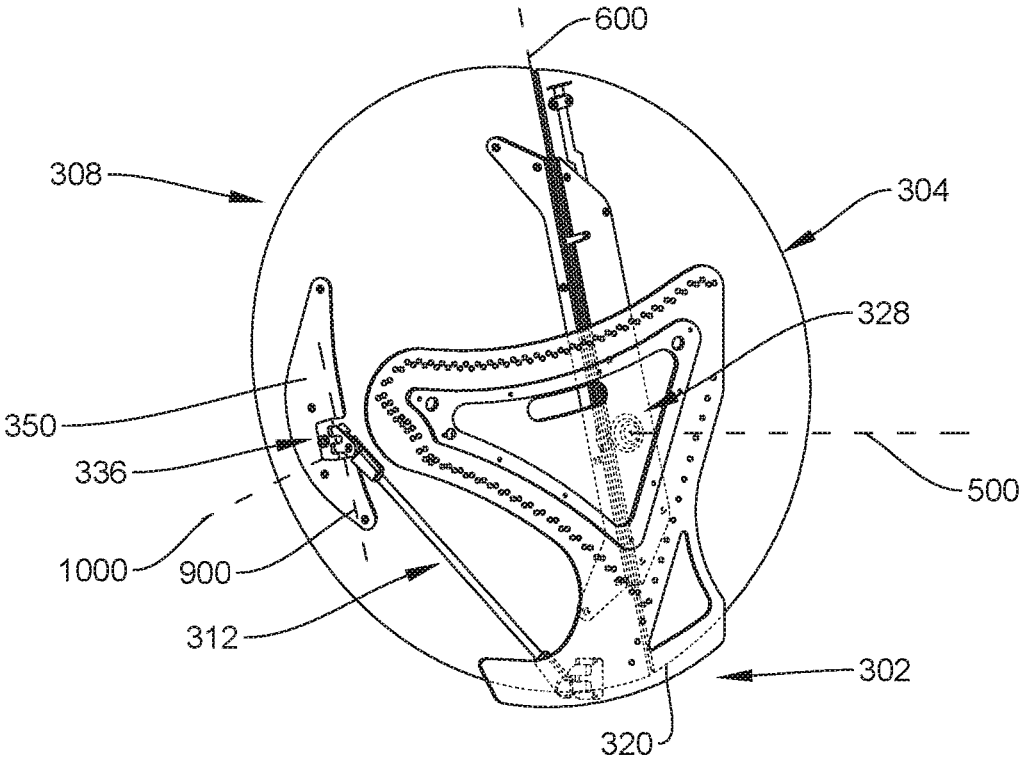
Figure 3C:
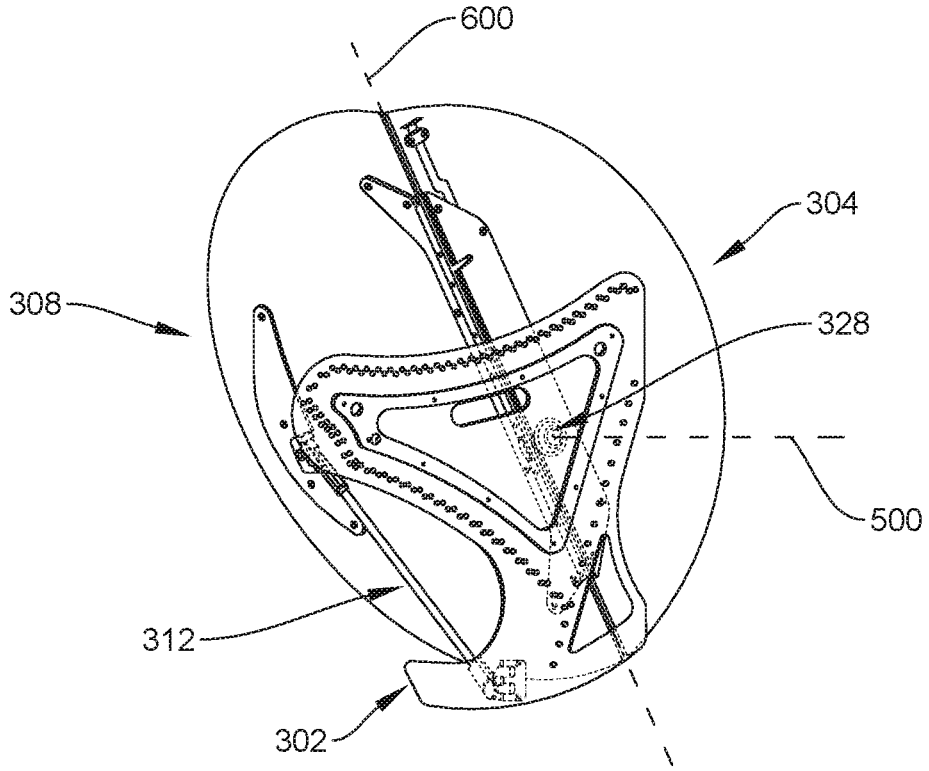
Figure 3D:
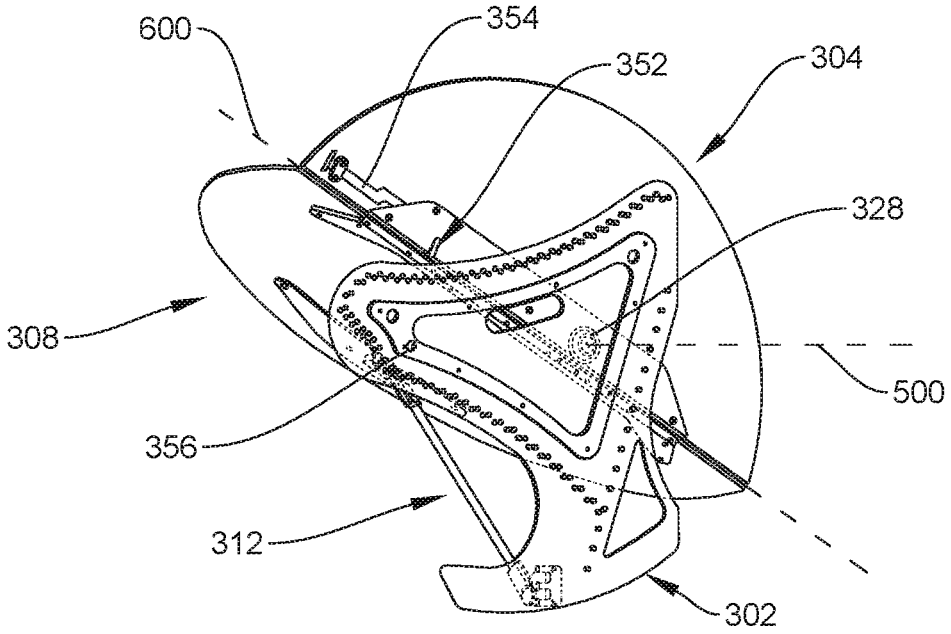
Figure 3E:
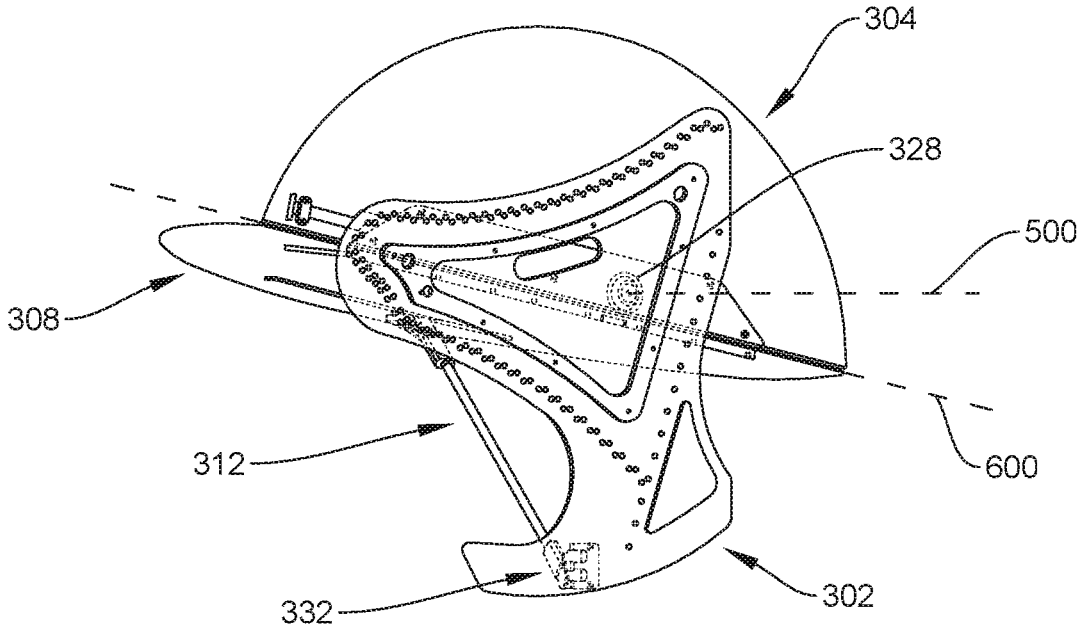
Figure 4A:
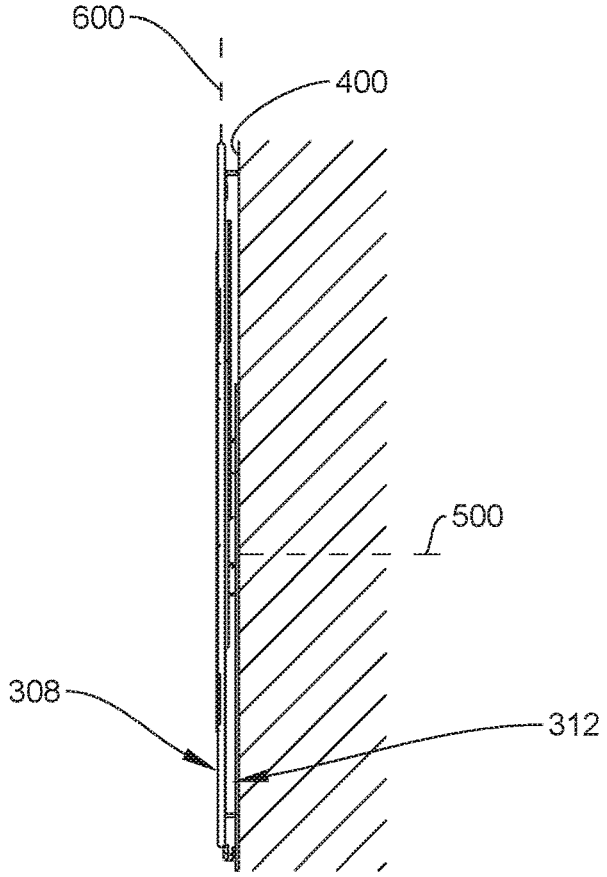
FIGS. 4A-4G present a succession of images illustrating movement of the apparatus of FIGS. 2A-2G between a stowed position against a support surface and a deployed position extended from the support surface, from a side view of the apparatus.
Figure 4B:
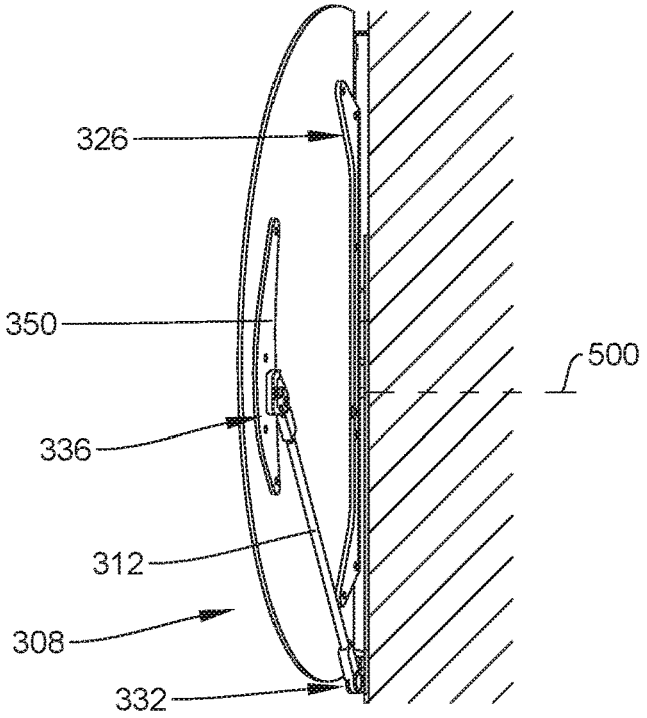
Figure 4C:
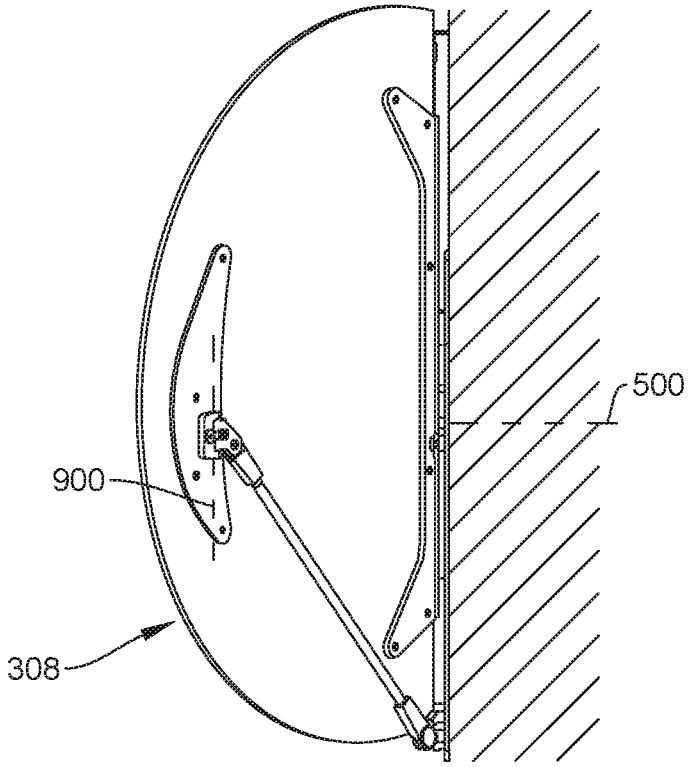
Figure 4D:
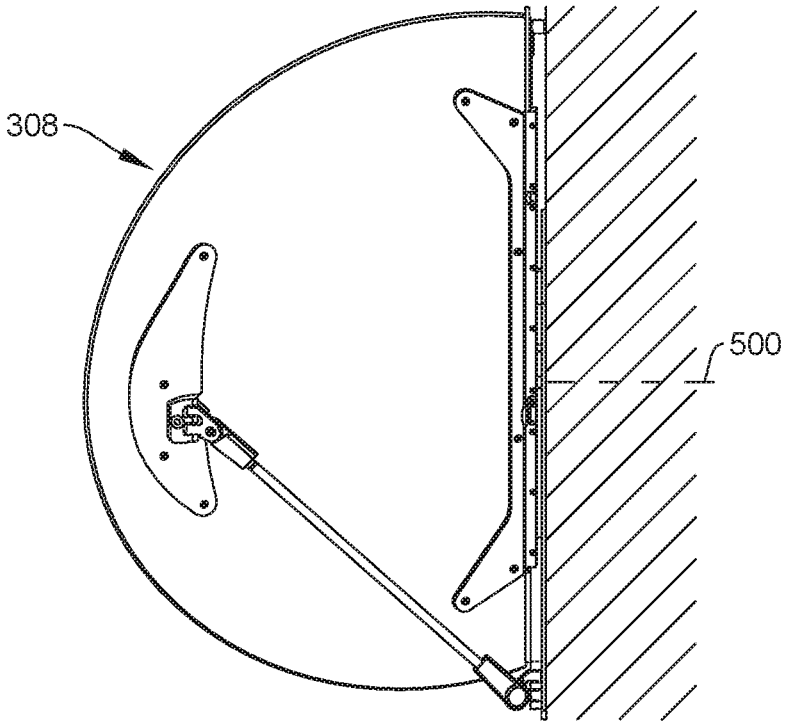
Figure 4E:
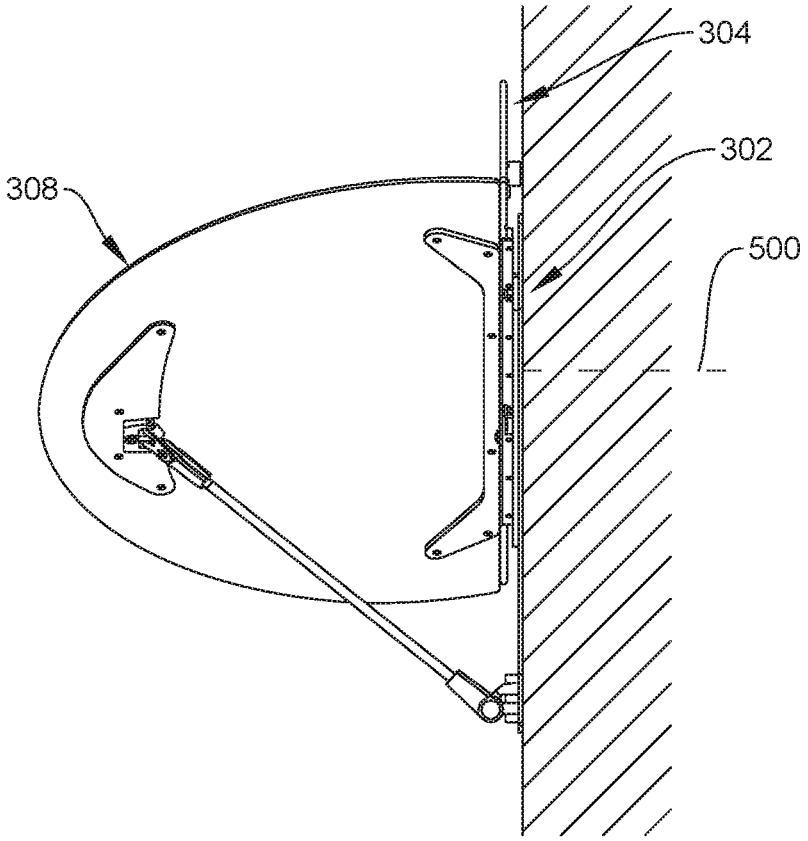
Figure 4F:
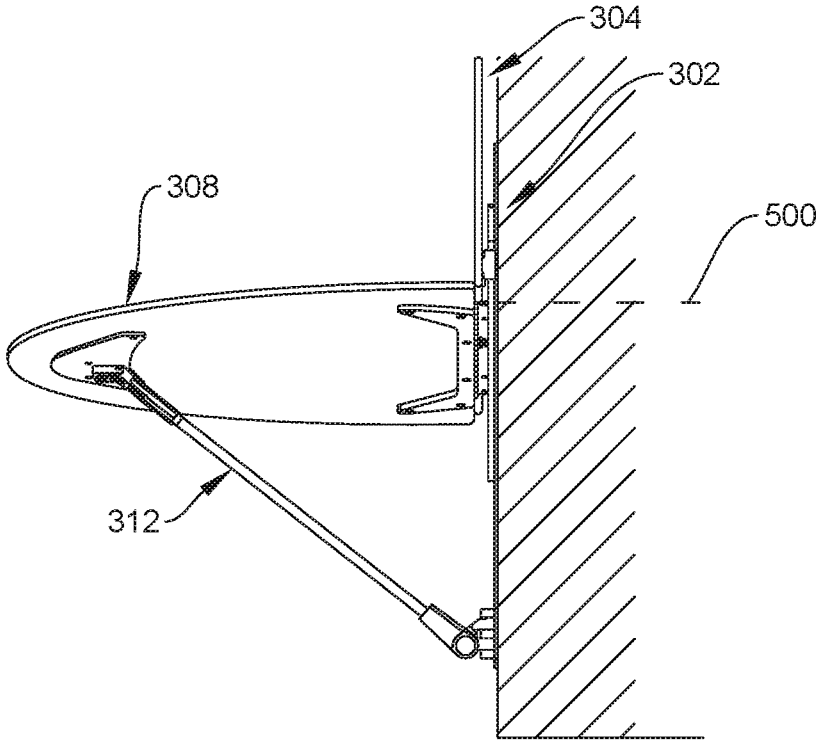

Operation of the furniture system 300 will now be discussed. FIGS. 2A, 3A, and 4A illustrate the furniture system 300 in a stowed or collapsed position against the support surface 400. In this position, outer surfaces (not labeled) of the first and second furniture pieces 304, 308 may generally reside in a common plane that is substantially parallel to the support surface 400. Further observations of the stowed position are that the longitudinal axis 337 of the support mechanism is parallel to the common plane and the support surface 400; and the second, third, and fifth pivot axes 600, 700, 900 are parallel (e.g., and substantially vertical in this embodiment).

To initiate movement or deployment of the furniture system 300 into its deployed position, a user may initially grab a portion of the second furniture piece 308 (e.g., about outer periphery of second furniture piece 308 opposite second pivot axis 600) and rotate the second furniture piece 308 away from the support surface 400 in a first direction about the second pivot axis 600 (e.g., clockwise as shown, although the furniture system 300 could be arranged vice versa in other embodiments) relative to the first furniture piece 304. See FIGS. 2B, 3B, and 4B. During this initial movement, the support mechanism 312 begins pivoting about the third pivot axis 700. Thereafter, the user may continue the deployment process by rotating the second furniture piece 308 in a first direction about the first pivot axis 500 (e.g., clockwise, as shown, although the furniture system 300 could be arranged vice versa in other embodiments) which thereby also simultaneously rotates the first furniture piece 304 in the first direction about the first pivot axis 500. Because the third pivot axis 700 is fixed on the mounting assembly 302 (e.g., due to the first pivot member 338 being rigidly fixed to the mounting assembly 302), rotation of the first and second furniture pieces 304, 308 about the first pivot axis 500 induces the mounting assembly 302 (and the support surface 400) to apply a reaction force against the support mechanism 312 along the longitudinal axis 337 and thus the second furniture piece 308 that urges the second furniture piece 308 about the second pivot axis 600 in the same direction as the user had initially moved the second furniture piece 308 to begin the deployment process. See FIGS. 2C-2D, 3C-3D, and 4C-4D. During this movement, the support mechanism 312 pivots about the third, fourth, fifth, and sixth pivot axes 700, 800, 900, 1000 while the second pivot assembly 336 (e.g., the fifth and sixth pivot axes 900, 1000) may rotate relative to the support mechanism 312 about the longitudinal axis 337.

The user may continue rotating the first and second furniture pieces 304, 308 about the first pivot axis 500 until the first and second furniture pieces 304, 308 have reached a desired rotational position about the first pivot axis 500 (e.g., as just one example, 90° from that shown in FIGS. 2*a*, 3*a*, and 4*a*, or in other words such that the outer/upper surface of the second furniture piece 308 and the second pivot axis 600 are horizontal) and/or until the outer surfaces of the first and second furniture pieces 304, 308 have reached a desired angle relative to each other (e.g., 90°) relative to the second pivot axis 600. See FIGS. 2E-2G, 3E-3F, and 4E-4G. In one arrangement, the second furniture piece 308 may rotate about the second pivot axis 600 relative to the first furniture piece 304 at a rotational speed that varies as a function of a rotational position of the first and second furniture pieces 304, 308 about the first pivot axis 500. For instance, upon initial rotation of the first and second furniture pieces 304, 308 about the first pivot axis 500 from the stowed position, the second furniture piece 308 may rotate about the second pivot axis 600 relative to the first furniture piece 304 at a first rotational speed. Upon further rotation of the first and second furniture pieces 304, 308 about the first pivot axis 500, the second furniture piece 308 may rotate about the second pivot axis 600 relative to the first furniture piece 304 at a second rotational speed greater than the first rotational speed. Upon even further rotation of the first and second furniture pieces 304, 308 about the first pivot axis 500 (and into the fully deployed position), the second furniture piece 308 may rotate about the second pivot axis 600 relative to the first furniture piece 304 at a third rotational speed less than the second rotational speed (e.g., and in one arrangement the same as the first rotational speed).

Figure 2G:
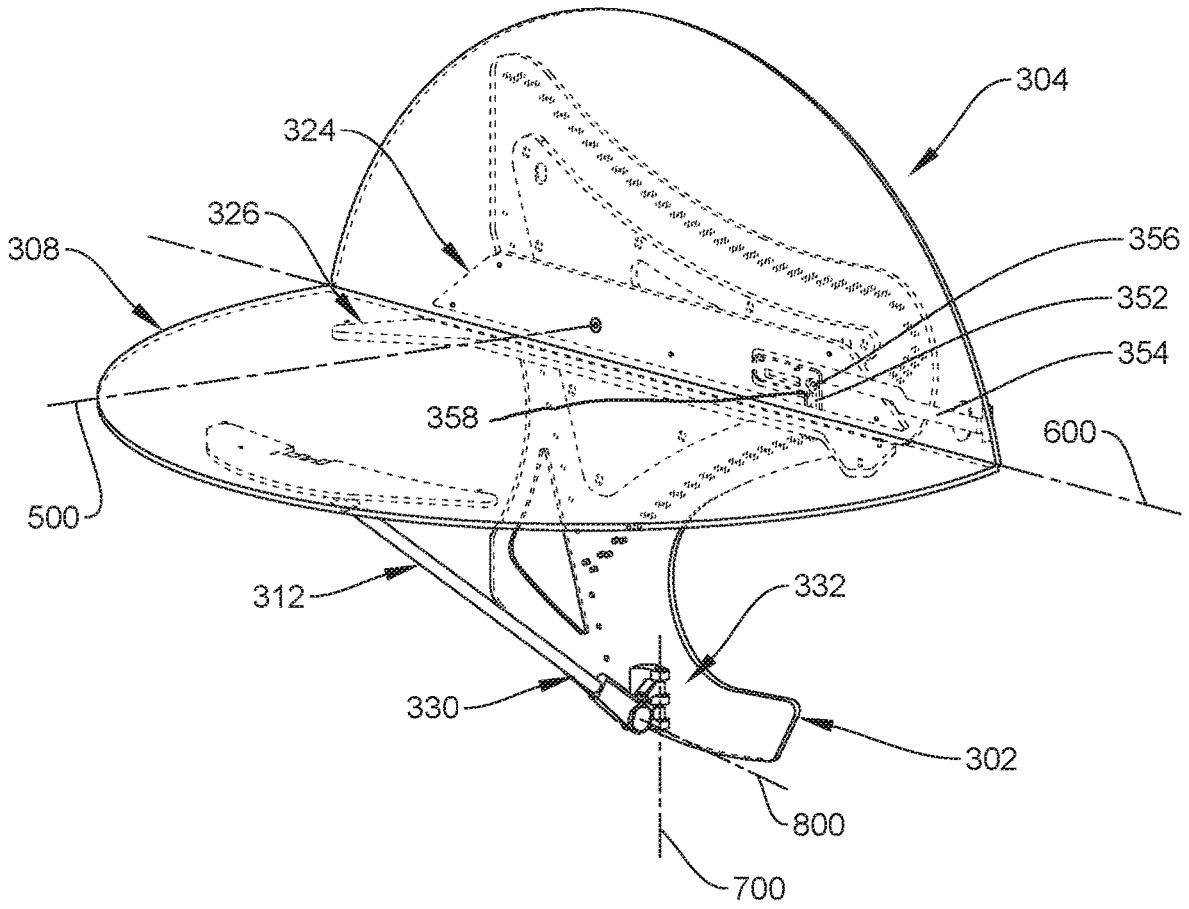
Figure 3F:
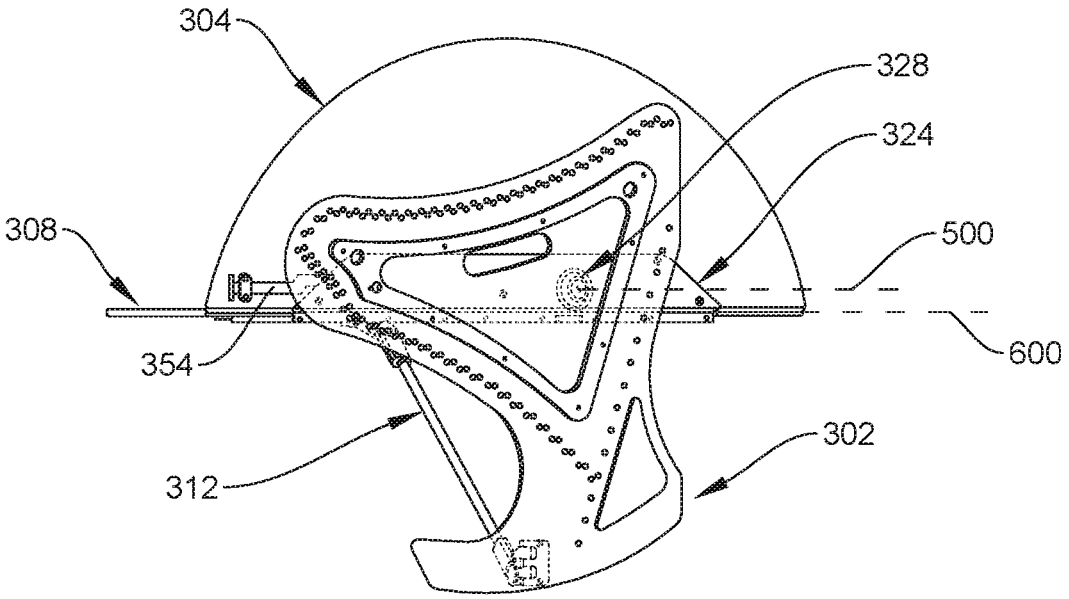
Figure 4G:
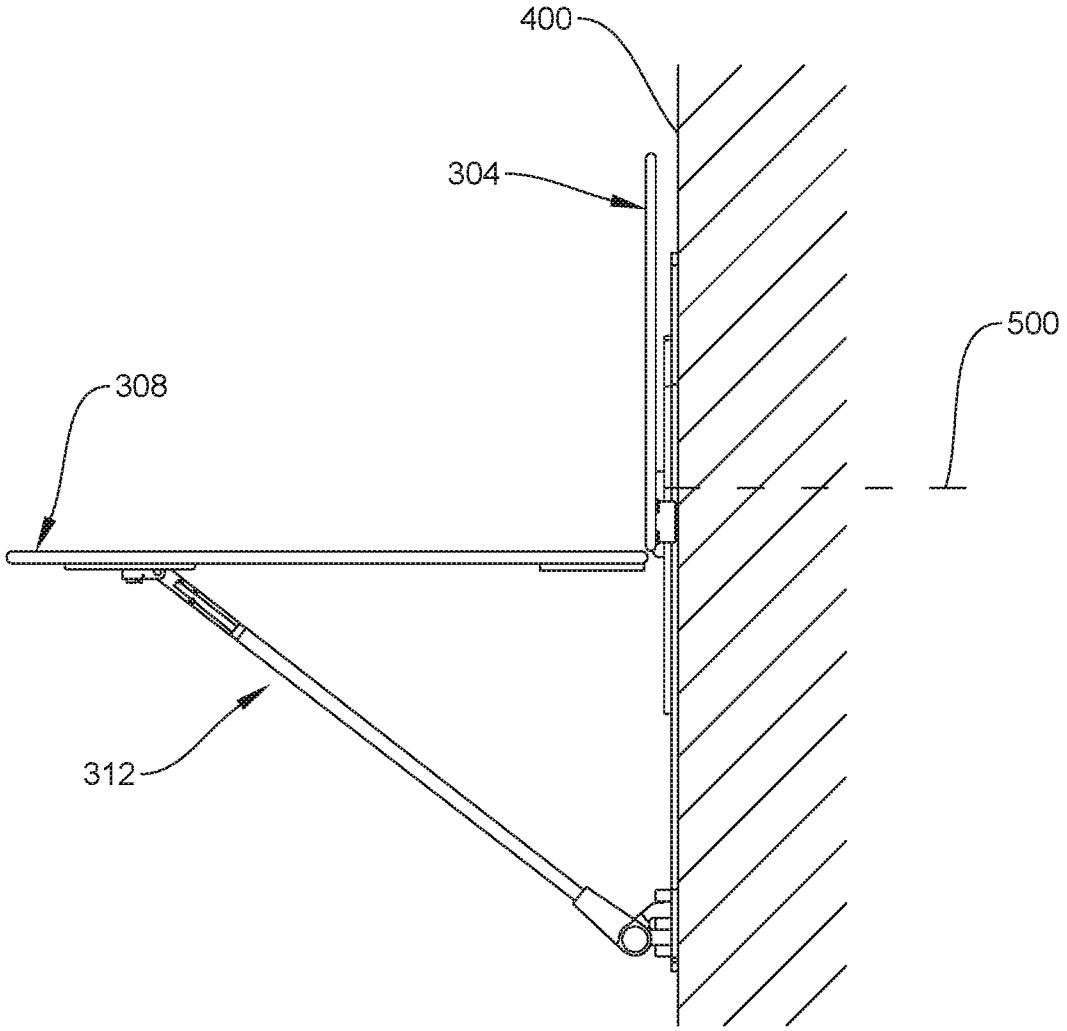

In one arrangement, any appropriate rotation prevention system may be incorporated into the furniture system 300 to inhibit further rotation of the first and second furniture pieces 304, 308 about the first pivot axis 500 when the first and second furniture pieces 304, 308 have reached the desired rotational position about the first pivot axis 500 (e.g., the deployed position illustrated in FIGS. 2G, 3F, and 4G). As an example, a first engagement apparatus may be attached to the first furniture piece 304 and a corresponding second engagement apparatus may be attached to the mounting assembly 302, where the first and second engagement apparatuses may selectively engage to inhibit further rotation of the first and second furniture pieces 304, 308 about the first pivot axis 500 (e.g., in the clockwise direction, in the clockwise and counterclockwise directions, etc.).

For instance, the first engagement apparatus may include a slot 352 in the first hinge member that is normally closed by a portion of a spring-loaded latch member 354. The second engagement member may be in the form of a projection 356 (e.g., rod, pin, etc.) protruding from the front surface 318 of the mounting assembly 302 that is configured to be received in the slot 352 as the first and second furniture pieces 304, 308 reach the desired position about the first pivot axis 500. With reference to FIGS. 2E-2D and 3D-3E, the slot 352 can be seen approaching the projection 356. Upon continued rotation of the first and second furniture pieces 304, 308 about the first pivot axis 500, the projection 356 contacts a catch 358 of the latch 354 that is intersecting the slot 352 and temporarily pushes the catch 358 out of the slot 352 to thereby displace the entire latch 354 against a biasing force of the latch (e.g., in a first direction parallel to the second pivot axis 600 in this example). Upon the further rotation of the first and second furniture pieces 304, 308 about the first pivot axis 500, the projection 356 eventually clears the catch 358 which allows the biasing force of the latch 354 to move the entire latch in an opposite second direction (e.g., parallel to the second pivot axis 600) and the catch 358 to again intersect and block the slot 352.

At this point, the projection 356 is contained in the slot 352 to inhibit rotation of the first and second furniture members 304, 308 about the first pivot axis 500 and thus maintain the first and second furniture members 304, 308 in the desired rotational position (e.g., in the position shown in FIGS. 2G, 3F, and 4G for instance). In one arrangement, the catch 358 may include a camming surface (e.g., tapered surface) such that contact of the camming surface by the projection 356 moving into the slot 352 urges the catch 358 out of the slot until the pin 356 has fully cleared the catch 358. However, the surface of the catch 358 opposite the camming surface may be configured to inhibit passage of the projection 356 out of the slot 352 absent a user manually moving (e.g., pushing) the latch 354 in the first direction against the biasing force to move the catch 358 out of the slot 352. The furniture system 300 is highly balanced and sturdy in the deployed position due to the pivot assembly 328, rotation prevention system, and support mechanism 312 serving as independent anchoring members that collectively inhibit movement of the first and second furniture pieces 304, 308 relative to the support surface 400.

To move the furniture system back into the collapsed or stowed position illustrated in FIGS. 2A, 3A, and 4A, the user may generally reverse the above-discussed steps. For instance, the user may initially manipulate (e.g., push) the latch 354 against the biasing force to move the catch 358 out of the slot 352 and allow for passage of the projection 356 out of the slot 352. The user may then rotate the first and second furniture pieces 304, 308 in the opposite rotational direction about the first pivot axis 500 (e.g., counterclockwise in this example). At some point, such continued rotation rotates the second furniture piece 308 away from the first furniture piece 304 about the second pivot axis 600 until the outer surfaces of the first and second furniture pieces 304, 308 again reside in a common plane in the stowed position of FIGS. 2A, 3A, and 4A.

It will be readily appreciated that many deviations may be made from the specific embodiments disclosed in the specification without departing from the spirit and scope of the invention. Initially, it is noted that one or more of a number of variables in the disclosed furniture systems may be adjusted in a variety of manners to allow the systems to be adapted for various applications, contexts, environments, and designs such as, but not limited to, a) the relative positioning between the first pivot axis 500 and the hinge 322, the first pivot assembly 332, and/or the second pivot assembly 336, b) the relative positioning between the first pivot axis 500 and the top outer surface of the second furniture piece 308, c) the amount of rotation about the first pivot axis 500 afforded to the first and second furniture pieces 304, 308, the length of the support mechanism 312, d) the location of the first pivot assembly 332 on the mounting assembly 302, e) the location of the second pivot assembly 336 on the second furniture piece 308, and/or the like.

While the desired rotational angle about the first pivot axis 500 has been illustrated as being 90°, such rotational angle may be one or more of any other angles depending upon the particular environment in which the system is deployed. In one arrangement, the rotation prevention system may be configured to allow for selective locking of the first and second furniture pieces 304, 308 at one of a plurality of desired rotational positions about the first pivot axis 500 depending upon the particular context in which the furniture system 300 is employed. While not illustrated, the furniture system may also incorporate a rotation prevention system to maintain the system in the stowed position of FIGS. 2A, 3A, and 4A. For instance, such rotation prevention system may include any appropriate magnetic latching arrangement. Furthermore, while the second piece 308 is illustrated as being larger than the first piece 304, the first and second pieces 304, 308 may be the same size or the first piece 304 may be larger than the second piece 308 in other embodiments.

In one arrangement, the furniture system may be configured to conceal and selectively provide access to one or more storage compartments or cavities disposed through or within the support surface 400. For instance, pivoting of the second piece 308 relative to the first piece 304 and/or rotation of the first and second pieces 304, 308 may reveal such compartments. In one arrangement, each of the first and second pivot assemblies 332, 336 may be in the form of a ball joint or the like to allow for simultaneous motion about three pivot axes (e.g., axes 700, 800, 337 in the case of the first pivot assembly 332; and axes 900, 1000, 337 in the case of the second pivot assembly 336). In one arrangement, the support mechanism 312 may incorporate more complicated arrangements of telescoping rods, pivot points, and the like based upon the degree of support necessary in the particular context. Furthermore, the furniture systems may be constructed of any appropriate materials, any appropriate dimensions, etc. Some components in various figures may be illustrated in dashed lines or the like to indicate that such components may be concealed by other components. Still further, while the present disclosure has been discussed in the context of furniture and been referred to as a "furniture system," it is envisioned that the present teachings can be used in various other contexts such as, but not limited to, mounting and deployment of solar panels, protective awnings, decking, etc.

Certain features that are described in this specification in the context of separate embodiments can also be implemented in combination in a single embodiment. Conversely, various features that are described in the context of a single embodiment can also be implemented in multiple embodiments separately or in any suitable subcombination. Furthermore, methods discussed herein may be practiced with more, fewer, different steps than as specifically presented herein. Moreover, although features may be described above as acting in certain combinations and even initially claimed as such, one or more features from a claimed combination can in some cases be separated from the combination, and the claimed combination may be directed to a subcombination or variation of a subcombination.

What is claimed is:

1. A method of operating a surface-mounted apparatus, comprising:

rotating first and second planar sections of an apparatus about a first pivot axis oriented normal to the surface that extends through the first section of the apparatus and into the surface; and pivoting, simultaneously with and induced by the rotating, the second planar section of the apparatus relative to the first planar section of the apparatus about a second pivot axis that is perpendicular to the first pivot axis from a stowed position against the surface into a deployed position extending from the surface.

2. The method of claim 1, further including:

extending, during the pivoting, a support mechanism from a stowed position against the surface into a deployed position extending between the surface and the second planar section of the apparatus.

3. The method of claim 2, further including:

pivoting, during the extending, the support mechanism about third and fourth pivot axes relative to the surface; and pivoting, during the extending, the support mechanism about fifth and sixth pivot axes relative to the second planar section of the apparatus.

4. The method of claim 3, wherein the third and fourth pivot axes are perpendicular, and wherein the fifth and sixth pivot axes are perpendicular.

5. The method of claim 4, wherein the third and fifth pivot axes are parallel in the stowed position and perpendicular in the deployed position.

6. The method of claim 5, wherein the fourth and sixth pivot axes are parallel in the stowed position and perpendicular in the deployed position.

7. The method of claim 1, wherein the rotating includes rotating the second pivot axis by 90 degrees.

8. The method of claim 1, wherein the rotating includes rotating the first and second planar sections of the apparatus in a first direction about the first pivot axis and the pivoting includes pivoting the second planar section of the apparatus relative to the first planar section of the apparatus in a first direction about the second pivot axis, and wherein the method further includes:

rotating the first and second planar sections of the apparatus in a second direction about the first pivot axis that is opposite to the first direction; and pivoting the second section of the apparatus relative to the first section of the apparatus in a second direction about the second pivot axis that is opposite to the first direction.

9. The method of claim 1, wherein a top surface of the second planar section is coplanar with a top surface of the first planar section in the stowed position, and wherein the top surface of the second planar section is perpendicular to the top surface of the first planar section in the deployed position.

10. The method of claim 1, wherein the first and second pivot axes do not intersect.

11. The method of claim 1, wherein the rotating includes:

rotating the first and second planar sections of the apparatus in a first direction about the first pivot axis until a first engagement member attached to the first planar section of the apparatus engages with a second engagement member attached to the surface in the deployed position to inhibit further rotation in the first direction about the first pivot axis.

12. The method of claim 1, wherein the apparatus is wall-mounted.

13. A furniture system, comprising:

a mounting assembly securable to a support surface;

a first planar section of furniture pivotally attached to the mounting assembly for rotation about a first pivot axis oriented normal to the support surface;

a second planar section of furniture pivotally attached to the first planar section of furniture for rotation about a second pivot axis that is perpendicular to the first pivot axis; and a support mechanism pivotally interconnected between the mounting assembly and the second planar section of furniture, wherein rotation of the second planar section of furniture about the second pivot axis induces rotation of the first planar section of furniture about the first pivot axis.

14. The system of claim 13, wherein the support mechanism is pivotal relative to the mounting assembly about third and fourth pivot axes, and wherein the support mechanism is pivotal relative to the second section about fifth and sixth axes.

15. The system of claim 14, wherein the third and fourth pivot axes are perpendicular, and wherein the fifth and sixth pivot axes are perpendicular.

16. The system of claim 15, wherein the fourth pivot axis is pivotal about the third pivot axis, and wherein the sixth pivot axis is pivotal about the fifth pivot axis.

17. The system of claim 14, wherein the support mechanism includes a longitudinal axis that is perpendicular to the fourth and sixth pivot axes, wherein the fifth and sixth pivot axes are pivotal about the longitudinal axis.

18. The system of claim 13, wherein the first planar section of furniture includes a first hinge member that is pivotally attached to the mounting assembly for rotation about the first pivot axis, and wherein the second planar section of furniture includes a second hinge member that is pivotally attached to the first hinge member for rotation about the second pivot axis.

19. The system of claim 13, further including:

a first engagement apparatus attached to the first planar section of furniture; and a second engagement apparatus attached to the mounting assembly, wherein the first and second engagement apparatuses engage to inhibit rotation of the first planar section of furniture about the first pivot axis.

20. The system of claim 13, wherein the first planar section of furniture rotates parallel to the support surface.

21. The system of claim 13, wherein the support mechanism is attached to and supports a planar surface of the second planar section of furniture.

22. An apparatus comprising:

a mounting assembly securable to a support surface;

a first planar section pivotally attached to the mounting assembly for rotation about a first pivot axis oriented normal to the support surface;

a second planar section pivotally attached to the first planar section for rotation about a second pivot axis that is perpendicular to the first pivot axis; and a support mechanism pivotally interconnected between the mounting assembly and the second planar section, wherein rotation of the second planar section about the second pivot axis induces rotation of the first planar section about the first pivot axis.

* * * * *